US005910100A

United States Patent [19]

Hooper

[11] Patent Number: 5,910,100

[45] Date of Patent: Jun. 8, 1999

[54] WASTE HEAT UTILIZATION

[76] Inventor: Frank C. Hooper, 5 King's College Road, Toronto, Ontario, Canada, M5S 1A4

[21] Appl. No.: 08/754,265

[22] Filed: Nov. 20, 1996

[51] Int. Cl.[6] ..... F01K 25/08

[52] U.S. Cl. ..... 60/651; 60/671

[58] Field of Search ..... 60/645, 668, 670; 123/41.21, 651, 671

[56] References Cited

U.S. PATENT DOCUMENTS 1,425,629 8/1922 Bell ..... 60/670

5,090,371 2/1992 Schäpertons et al. ..... 123/41.21

*Primary Examiner*—Noah P. Kamen

[57] ABSTRACT

A self-actuated exhaust fan is useful for removing waste heat from fluids, especially gases. The process is provided for extracting a first gas from a hot gas source. The first gas has a temperature above ambient temperature. Condensed working fluid is vaporized in an evaporator by extracting the first gas from the hot gas source and passing the first gas in contact with heat transfer surfaces of the evaporator by a first fan. The first fan is driven by an engine. The working fluid so-vaporized is allowed to enter the engine through an inlet port and exhaust through an exhaust port and thus operate the engine. The exhausted working fluid vapour is condensed in a condenser by passing cooler outside air in contact with heat transfer surfaces of the condenser by means of a second fan. The second fan is also driven by the engine. The condensed working fluid is transferred from the condenser to the evaporator by means of a feed pump which is driven by the engine. An advantage of the arrangement is that the working fluid is sealed within the system and normally requires no make-up and releases no fluid to the atmosphere.

19 Claims, 4 Drawing Sheets

WASTE HEAT UTILIZATION

FIELD OF THE INVENTION

The present invention relates to a method of utilizing so-called waste heat from fluids, especially gases. In particular it relates to a method for providing a self-propelled hot gas exhaust system.

BACKGROUND TO THE INVENTION

There is a need to provide methods for utilizing heat from sources that are heretofore generally referred to as waste heat. Such methods would provide a more efficient use of resources, reduce the emissions of products of combustion, and minimize the increase of temperature of the environment, e.g. air and water. For example, in many power stations, power houses and the like, fuels are burnt to provide hot gases. The hot gases are used to turn gas turbines, convert water into steam to turn steam turbines, or perform other useful work. However, not all of the heat from the burned fuel can be converted into useful work and the gases are vented to the atmosphere while they are still warm. The heat in the vented gases is sometimes referred to as waste heat. Heretofore, it has been difficult to recover waste heat and convert a part of it to useful work because such conversion is less efficient at lower temperatures. Accordingly recovery of waste heat to power is not common.

In some industrial operations such as furnace operations in a building in which the furnace is housed, the air in the building tends to get very hot. For the comfort and safety of workers in the building it is important to extract the hot air from the building. In the past this has been done by extracting the hot air using fans. It is usual for such fans to be electrically driven. Fuel is used in electricity generating stations to generate such electricity. If it would be possible to operate the fans without such electrical consumption there would be savings in the purchase of electrical power. In addition, there would be a net positive effect on the environment in terms of fewer emitted pollutants, e.g. carbon dioxide, sulphur dioxide, nitrogen oxides, particulates and the like associated with power plant operations.

The present invention seeks to provide a method for providing a self-propelled exhaust fan by recovering heat from warm exhaust gases and converting some of the heat to shaft power to drive the fan. The invention also seeks to provide a method for recovery of work from relatively low temperature fluids, e.g. waste heat.

SUMMARY OF THE INVENTION

As used herein, the terms "cold", and "hot" are used relative to one another, e.g. cold air has a lower temperature than hot air. For purposes of the present disclosure, the term "cold" encompasses the term "cool", and may be used interchangeably herein, and the term "hot" encompasses the term "warm", and may be used interchangeably herein.

The term "expander" is sometimes used by those skilled in the art for the part of the present apparatus which is referred to herein as the engine.

The present invention provides a process for extracting a first fluid from a hot fluid source, said first fluid having a temperature above ambient temperature, said process comprising:

(i) causing condensed working fluid to vaporize in an evaporator by extracting the first fluid from the hot fluid source and passing the first fluid in contact with heat transfer surfaces of the evaporator by a first fluid transferring means, said first fluid transferring means being driven by an engine;

(ii) allowing the working fluid so-vaporized to enter the engine through an inlet port and exhaust through an exhaust port and thus operate the engine;

(iii) causing the exhausted working fluid vapour to condense in a condenser by passing a second fluid, from a cold fluid source, in contact with heat transfer surfaces of the condenser by means of a second fluid transferring means, said second fluid transferring means being driven by the engine;

(iv) cause the condensed working fluid to be transferred from the condenser to the evaporator by means of a feed pump which is driven by the engine.

In one embodiment, the first and second fluids are gases and the first and second fluid transferring means are fans.

In another embodiment, the first and second fluids are liquids and the first and second fluid transferring means are pumps.

In a further embodiment, the first fluid is a liquid and the second fluid is a gas, the first fluid transferring means is a pump and the second fluid transferring means is a fan.

In another embodiment, the first and second fluids are air and the first and second fluid transferring means are fans.

In yet another embodiment, the first gas is air from within a warm space and the second gas is air from outdoors, wherein the temperature of the first gas is at least 25° C. higher than the temperature of the second gas.

In a further embodiment, the first gas is air from within a warm space and the second gas is air from outdoors, wherein the temperature of the first gas is at least 40° C. higher than the temperature of the second gas.

In yet another embodiment, the working fluid has usefully high vapour pressures and vapour densities in the temperature range of from about 20 to about 120° C. In a preferred embodiment the working fluid is a fluorocarbon, especially a chlorofluorocarbon (CFC), a hydrochlorofluorocarbon (HCFC) or a hydrofluorocarbon (HFC).

In a further embodiment, the engine is selected from the group consisting of a rotary expander, a reciprocatory expander and an expansion turbine.

In another embodiment, the rotary expander is a gerotor.

The present invention also provides an apparatus comprising:

(a) an engine having an inlet port and an exhaust port for a working fluid, said engine being operable by a working fluid;

(b) an evaporator for the working fluid, said evaporator being connected to the inlet port of said engine to allow evaporated working fluid gas to enter the inlet port;

(c) a condenser for the working fluid, said condenser being connected to the exhaust port of said engine, to allow condensation of the working fluid gas into liquid working fluid and thus provide a pressure difference for exhaustion of working fluid gas from the exhaust port;

(d) a pump, in driven relationship with the engine, for transferring liquid working fluid from the condenser to the evaporator;

(e) a first fluid transferring means, in driven relationship with the engine, said first fluid transferring means being positioned to pass a first fluid in contact with heat transfer surfaces of the evaporator; and (f) a second fluid transferring means, in driven relationship with the engine, said second transfer means being positioned to pass a second fluid in contact with heat transfer surfaces of the condenser.

In one embodiment, the first and second fluids are gasses and the first and second fluid transferring means are fans.

In another embodiment, the engine is selected from a reciprocating engine, a rotary engine and an expansion turbine. Preferably the engine is a gerotor.

In a further embodiment, the working fluid has usefully high vapour pressures and vapour densities in the temperature range of from about 20 to about 120° C. In a preferred embodiment the working fluid is a fluorocarbon, especially a chlorofluorocarbon (CFC), a hydrochlorofluorocarbon (HCFC) or a hydrofluorocarbon (HFC).

In another embodiment, the fluorocarbon is selected from chlorofluorocarbon 12, chlorofluorocarbon 22, hydrochlorofluorocarbon 123 and hydrochlorofluorocarbon 124.

In a further embodiment, the first fan is positioned to extract hot air from within a space, and the second fan is positioned to transfer cold air into the space from a position outside the space.

In yet another embodiment, the first fan is positioned to extract hot air from within a space, and the second fan is positioned to transfer cold air from one position outside the space into a second position outside the space.

The present invention further provides an improved gerotor engine comprising;

(a) an outer gerotor element which has an axis of symmetry;

(b) a rotatable inner gerotor element, which has an axis of rotation which is eccentric to and rotatable about the axis of symmetry of the outer gerotor element, and which is centred on and attached to a shaft;

(c) a barrel which is coaxial with the axis of symmetry and encases the outer gerotor element;

(d) first and second end plates, each attached to the barrel and encasing the inner and outer gerotor elements within the barrel;

(e) an inlet port in the first end plate, in which the inlet port has a forward portion, said forward portion being closest to the direction of rotation of the inner gerotor element;

(f) an exhaust port;

(g) a shroud which may partially cover the forward portion of the inlet port; and (h) a means for moving the shroud from a position of partially covering the forward portion of the inlet portion of the inlet port to a position where the inlet port is fully open, and vice-versa, the function of said shroud being a cut-off device for gas entering the inlet port.

In one embodiment, the shroud is provided by a rotatable plate which has an aperture therein, at least as large as the inlet port, said plate being placed between the first end plate and the gerotor elements and is rotatable about the axis of symmetry of the outer gerotor element such that when rotated the plate may move from a first position where a portion of the plate covers the forward portion of the inlet port to a second position where the first aperture allows unrestricted passage of gas into the inlet port, including the forward position of the inlet port.

The present invention also provides a closed cycle engine comprising:

(a) an outer gerotor element which has an axis of symmetry;

(b) a rotatable inner gerotor element, which has an axis of rotation which is eccentric to and rotatable about the axis of symmetry of the outer gerotor element, and which is centred on and attached to a shaft, said shaft being attachable to a driven load;

(c) a barrel which is coaxial with the axis of symmetry and encases the outer gerotor element;

(d) first and second end plates, each attached to the barrel and encasing the inner and outer gerotor elements within the barrel;

(e) an inlet port in the first end plate, in which the inlet port has a forward portion, said forward portion being closest to the direction of rotation of the inner gerotor element;

(f) an exhaust port;

(g) a shroud which may partially cover the forward portion of the inlet port; and (h) a means for moving the shroud from a position of partially covering the forward portion of the inlet portion of the inlet port to a position where the inlet port is fully open, and vice-versa, the function of said shroud being a cut-off device for gas entering the inlet port;

(i) an evaporator for a working fluid, said evaporator being connected to the inlet port of said gerotor engine to allow evaporated working fluid gas to enter the inlet port;

(j) a condenser for the working fluid, said condenser being connected to the exhaust port of said gerotor engine, to allow condensation of the working fluid gas into working fluid liquid and thus provide a driving force for exhaustion of working fluid gas from the exhaust port; and (k) means for transferring working fluid liquid from the condenser to the evaporator.

In one embodiment, there is a means for measuring the speed of rotation of the shaft, said means being connected by a controller to the means for moving the shroud such that when the speed of rotation of the shaft begins to decrease, or if the driven load requires a higher shaft speed, the shroud is moved to extend the open period of the inlet. Conversely the shroud is moved to reduce the open period before cut-off if the speed begins to increase above a set speed, or if the set speed is reduced in response to a requirement of the driven load.

In another embodiment, the shroud is provided by a rotatable plate which has a first aperture at least as large as the inlet port, said plate being placed between the first end plate and the gerotor elements and is rotatable about the axis of symmetry of the outer gerotor element such that when rotated the plate may move from a first position where a portion of the plate covers the forward portion of the inlet port to a second position where the first aperture allows unrestricted passage of gas into the inlet port, including the forward position of the inlet port.

DETAILED DESCRIPTION OF PREFERRED EMBODIMENTS

Figure 1:
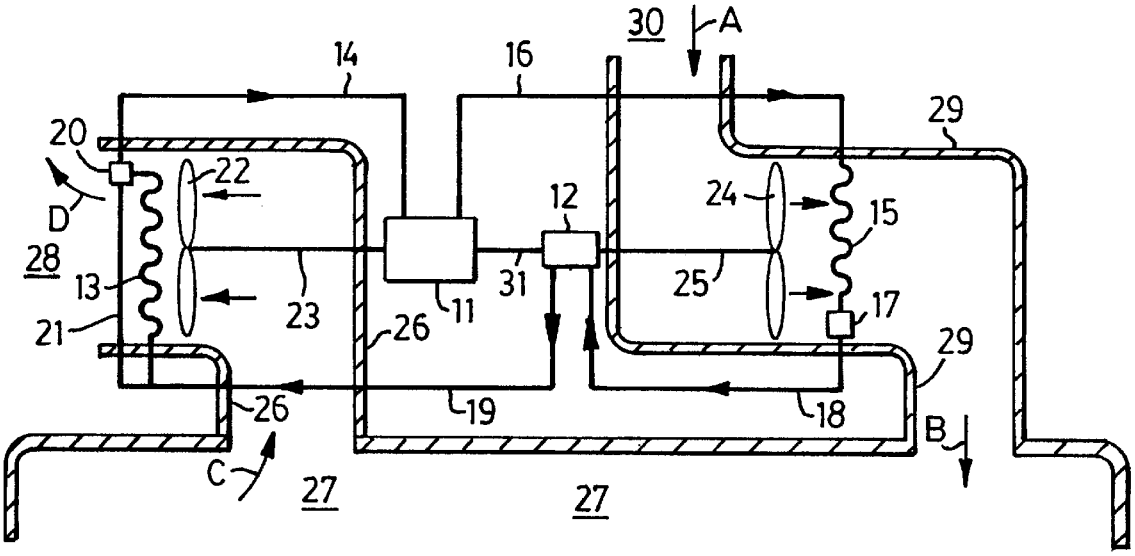
FIG. 1 is a schematic representation of one embodiment of the present invention, showing a closed cycle engine powered from a hot air source, which drives a fan for passing the hot air over an evaporator for the closed cycle engine.

As used herein, the term "line" is used to refer to tubing or piping.

An exhaust port (not shown) of engine 11 is connected to condenser 15 by line 16. Condenser 15 has a condensate well 17, which is connected by line 18 to an inlet (not shown) of feed pump 12. An outlet (not shown) of feed pump 12 is connected to evaporator 13 by line 19. An outlet from evaporator 13 is connected to a separator 20. Separator 20 has a return line 21 which is connected to line 19. Separator 20 is also connected by line 14 to an inlet to engine 11.

Engine 11 is in driving relationship with fan 22 via shaft 23. Fan 22 is adjacent to evaporator 13 and is intended for passing a first gas, e.g. hot or warm air over evaporator 13. Engine 11 is also in driving relationship with feed pump 12 via shaft 31, and with fan 24 via shaft 25. Fan 24 is adjacent to condenser 15 and is intended for passing a second gas, e.g. cold or cool air, over condenser 15. It will be appreciated that the fans 22, 24 and feed pump 12 may be driven by engine 11 using driving means other than shafts 23 and 25. For example, fan 24 and feed pump 12 may be driven by separate shafts, belts, gear trains or the like as will be understood by those skilled in the art.

Evaporator 13 is located within vent 26, through which the first gas, e.g. air, may be extracted from a room 27 to atmosphere 28. Condenser 15 is located within vent 29, through which cool second gas, e.g. air, may be drawn from atmosphere 30. In the embodiment shown in the drawing, the fresh and relatively cool second gas may be distributed within room 27. It will be understood that distribution may be through a single outlet into room 27 or may be through several outlets distributed along a header (not shown). In an alternate arrangement (not shown) the cool second gas may be vented back to atmosphere rather than being directed into room 27.

Evaporator 13 feeds working fluid, e.g. fluorocarbon vapour to an inlet port (not shown) of engine 11 via line 14. As indicated hereinbefore, an exhaust port (not shown) of engine 11 is connected to condenser 15 via line 16. Condensed fluorocarbon liquid drops into condensate well 17 and enters feed pump 12 via line 18. Feed pump 12 then feeds liquid fluorocarbon to evaporator 13 via line 19. Liquid and gaseous fluorocarbons from evaporator 13 are separated by separator 20 and liquid is returned in return line 21.

Evaporator fan 22 is placed in vent 26 which connects a room 27 (not shown in its entirety) to atmosphere (shown at 28). Condenser fan 24 is outside room 27, in a cold air source, or in a pipe 29 which is able to channel cold air from the atmosphere at 30 and then vent the air into room 27, thus providing a positive source of cool fresh air into room 27. Alternatively, the air may be vented into another location, e.g. back out to atmosphere.

The present invention is useful for the extraction of waste heat, e.g. in hot or warm air from buildings such as furnace rooms, foundries, bakeries and the like. In the embodiment illustrated in FIG. 1 the first gas, i.e. hot air is drawn from room 27, as indicated by arrow C, through vent 26, then over the heat transfer surfaces of evaporator 13 by evaporator fan 22 before being exhausted to atmosphere at 28, as indicated by arrow D. The heat is used to evaporate fluorocarbon liquid or other working liquid in evaporator 13. The resulting high pressure vapour in turn enters the inlet port of engine 11, thus powering engine 11. Exhausted gaseous working fluid from engine 11 is condensed in condenser 15, which is cooled by a second gas, e.g. external air from source 30. The external air is drawn from the outside at 30, as indicated by arrow A, through pipe 29, and driven over the heat transfer surfaces of condenser 15 by condenser fan 24 before being exhausted into room 27, as indicated by arrow B, or being exhausted to the atmosphere. In this way the heat from the hot air source, e.g. room 27, is used to work not only an extractor fan for the hot air but also a cooling fan for the condenser. In such a manner the extraction of hot air from room 27 has been accomplished by use of a self-propelled engine. If there is more power available from the engine, it can be used to power other machinery.

The temperature of the first gas, i.e. hot air for the evaporator is preferably at least 25° C. above the temperature of the air or other gas for the condenser. In this case where a fluorocarbon is used as the working fluid, the present invention is suitable for hot air having temperatures as low as about 50° C., or even lower if the temperature differential between the first and second gases is at least about 30° C. Preferred second gas temperatures are less than about 20° C.

The arrangement is also applicable for recovering energy from waste heat in liquids such as water. In such an instance, the first fluid is hot water. The condenser may be cooled with cold air or cold water. In such a case the means for transferring water over the heat transfer surfaces of the evaporator and condenser is preferably a pump. However other means such as gravity driven flows, water ram pumps and other pumps may also be used.

The preferred engine is a gerotor. Particularly preferred is a gerotor powered by a fluorocarbon working fluid. One such gerotor is disclosed in detail hereinafter. It will be understood by those skilled in the art that gerotors have one less lobe on the inner rotor than there are lobes on the inner rotor.

Although a gerotor engine is preferred, other engines may also be used in the operation of the present invention, e.g. reciprocating piston engines.

As will be seen hot gases are drawn from a warm space by a fan. The warm air serves as the only energy source to vaporize the working fluid in the evaporator of the low temperature vapour engine before being ejected to the atmosphere. The condenser is cooled by outdoor air circulated over its heat transfer surfaces by a second fan. Both fans and the feed pump are driven by power from the shaft of the expansion engine. Thus only the warm air serves as the energy source and no other external source and energy is needed to operate the exhaust fan.

The present invention has the desirable characteristic that the higher the temperature of the first gas, i.e. the gas being vented, the greater will be the speed and power of the engine and the exhausting capacity of the fan will be correspondingly increased.

It will be apparent that the present invention is suitable for venting hot air from industrial buildings, large kitchens, boiler rooms and the like. It will also be apparent that the present invention could be used to supplement electrically or other powered fans or to supplant them in the event of power failures.

FIGS. 2 to 6 show an improved gerotor which may be used as the engine for driving the first and second fluid transferring means.

Figure 2:
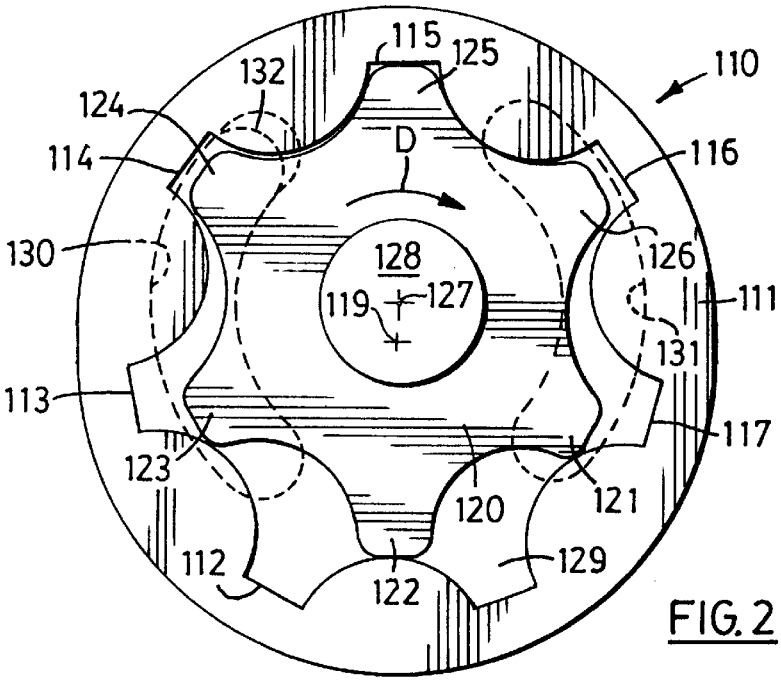
FIG. 2 is an axial view of a gerotor, with 7 outer lobes and 6 inner lobes, of the present invention showing inlet and outlet ports, and a cut-off shroud at the inlet port.

As shown in FIG. 2, engine 110 comprises outer gerotor element 111 and inner gerotor element 120. Outer gerotor element 111 has seven indents 112 to 117 which are equally spaced and are centred upon axis 119. Axis 119 is sometimes referred to herein as the axis of symmetry of outer gerotor element 111. Inner gerotor element 120 has six lobes 121 to 125 which are equally spaced and are centred upon axis 127. Axis 127 is eccentric to axis 119. Inner gerotor element 120 is held within outer gerotor element 111 by body elements (not shown). Inner gerotor element 111 is attached to and centred upon output shaft 128. Shaft 128 is used to drive other devices, e.g. pumps, fans, propellers, gear trains. Between inner gerotor element 120 and outer gerotor element 111 are cavities, one of which is shown at 129.

One of the body elements (better shown in FIG. 3) has an inlet port 130 on one side of axis 119 and an exhaust port 131 on the opposing side of axis 120. One end of inlet port 130 has a moveable shroud 132, the purpose of which is to provide a variable cut-off for high pressure gases/vapours entering through inlet port 130 into cavities between inner and outer gerotor elements 111 and 120.

Figure 4A:
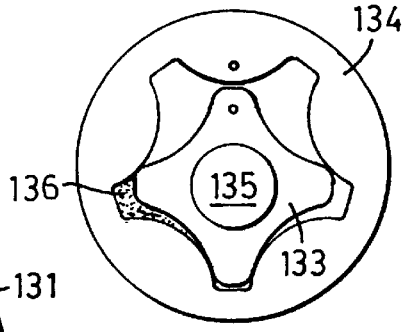
FIGS. 4A to 4G are cross-sectional representations of the progressive rotation of an inner gerotor element within an outer gerotor element of a 4-lobe gerotor.
Figure 4B:
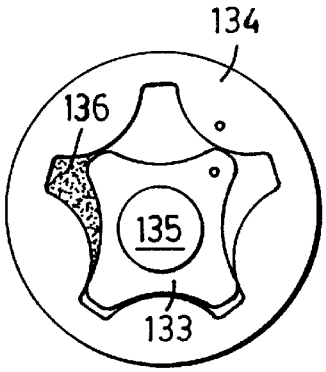
Figure 4C:
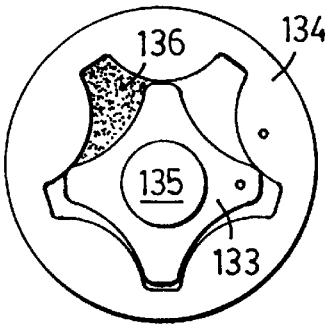
Figure 4D:
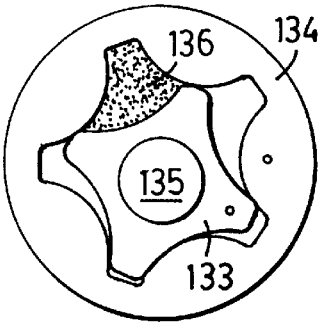
Figure 4E:
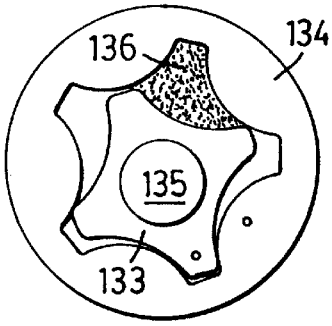
Figure 4F:
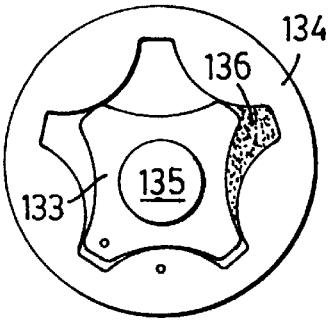
Figure 4G:
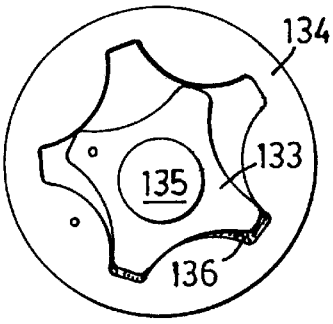

FIGS. 4A to 4G show the progressive rotation of inner gerotor element 133, which has four lobes, within outer gerotor element 134, which has five lobes. Inner gerotor element is connected to output shaft 135. In FIGS. 4A to 4G rotation of inner and outer gerotor elements 133 and 134 are in a clockwise direction. As can be seen from FIGS. 4A to 4D, the volume of cavity 136, shown in black, becomes progressively larger. As inner gerotor element 133 continues to rotate relative to outer gerotor element 134 as shown in FIGS. 4E to 4G, the volume of cavity 136 becomes smaller. When such a gerotor is used as an engine, high pressure gas or vapour is allowed to enter cavity 136. This forces the volume of cavity 136 to expand and thus rotate inner gerotor element 133. The gas is then exhausted, thus allowing continued rotation of inner gerotor element 133 and consequent diminishing of volume in cavity 136.

Instead of providing a constant supply of high pressure gas throughout the volume expansion phase, it is preferable from an energy utilization efficiency standpoint to cut the supply of high pressure gas off prior to attainment of maximum volume of cavity 136. This allows expansion of the gas to take place with a consequent lowering of the pressure. With cut-off always being at a fixed position, as in prior gerotors, it is impossible to maintain constant rotation speeds for output shaft 135 when the load on the shaft varies. Additionally, the energy utilization efficiencies of prior gerotors as engines are not as high as they could be. The present invention provides for a movable shroud which can alter the cut-off position and thus improve efficiency.

Figure 3:
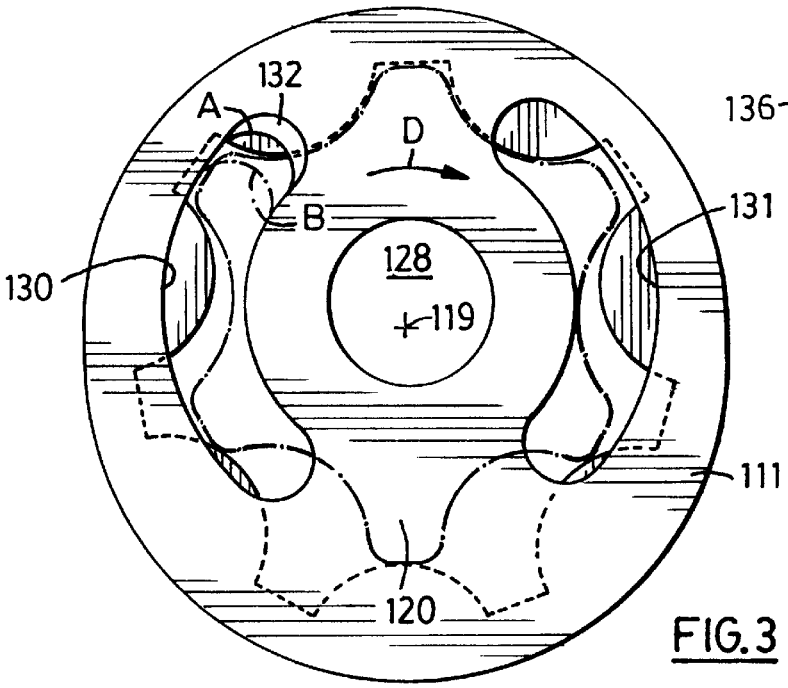
FIG. 3 is a view similar to FIG. 2, showing the cut-off shroud in different positions.

With reference to FIG. 3, inner gerotor element 120 is rotatable in a clockwise direction as shown by arrow D. Shroud 132 may be moved to position A when the power requirements for shaft 128 is normal. As the power requirement decreases on shaft 128, shroud 132 may be moved to position B in order to cut off the supply of high pressure gas at an earlier time in the cycle. The shroud may, in the limit, be moved to allow admission of the high pressure gas through the full expansion period of the cavity, to provide maximum power to meet the heaviest loads, although at a lower energy utilization efficiency.

Figure 5:
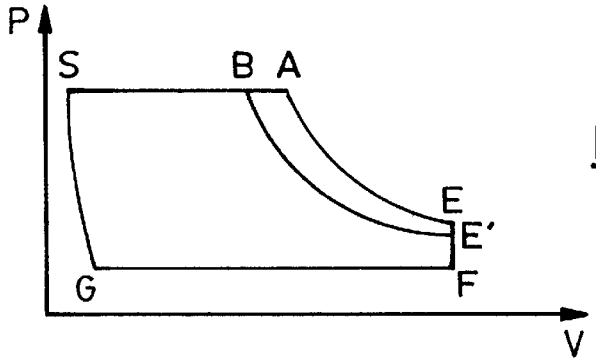
FIG. 5 is a graph of the pressure to volume within a gerotor cavity, illustrating the effect of using cut-off shrouding at the inlet port.

The pressure-volume relationship of the gas, within cavity 136 is shown in FIG. 5. High pressure gas is first allowed to enter the cavity as shown at point S. This causes the volume to expand. When shroud 132 is at position A as shown in FIG. 3, which corresponds to position A in FIG. 5, the high pressure gas is cut off. This permits the gas to expand in cavity 136 until maximum expansion has occurred, at position E. At this point, the gas is exhausted through exhaust port 131 and the pressure is reduced to point F. Inner gerotor element 133 continues to rotate, thus diminishing the volume in cavity 136, until point G is reached. At point G, the exhaust port has closed off the cavity, and the pressure of the trapped gas rises as the volume in cavity 136 diminishes further. The inner gerotor element rotates further until the inlet port is reached at point S and high pressure gas is again introduced.

When shroud 132 is moved to position B, in order to provide an earlier cut off for the engine under a lighter load, the gas expands until point E'. It will be understood that shroud 132 may be moved manually or automatically in order to maintain constant speed of rotation of inner gerotor element under varying engine loads, or to vary the speed to accommodate a changed requirement of the driven system.

Figure 7:
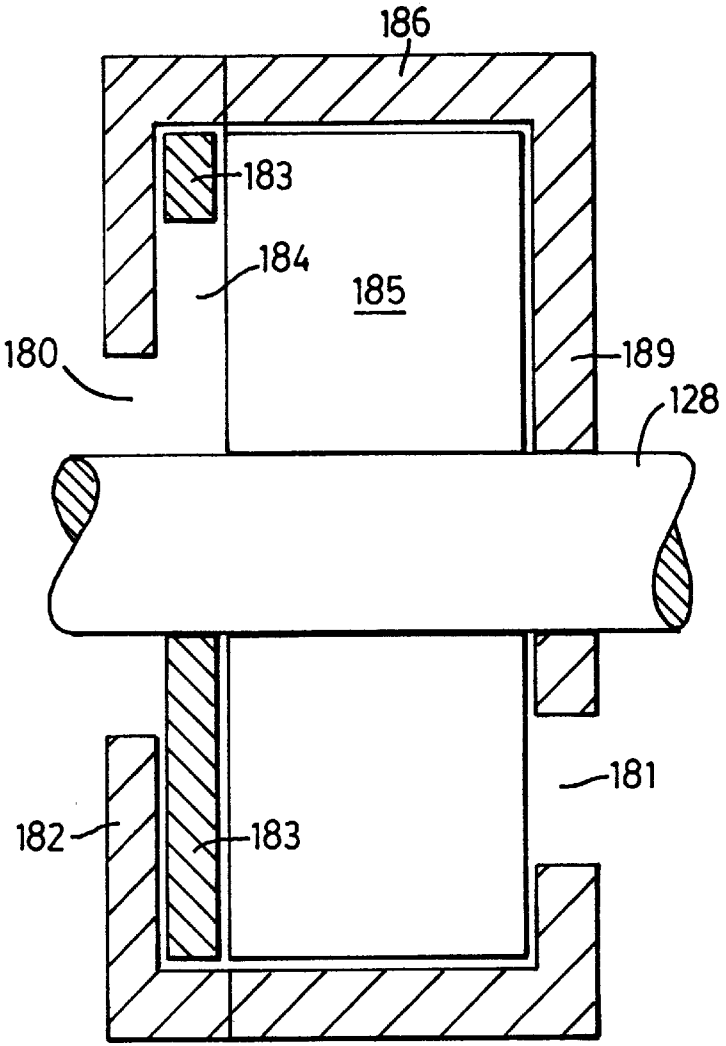
FIG. 7 is a cross-sectional side view of a gerotor with a shroud plate.
Figure 6:
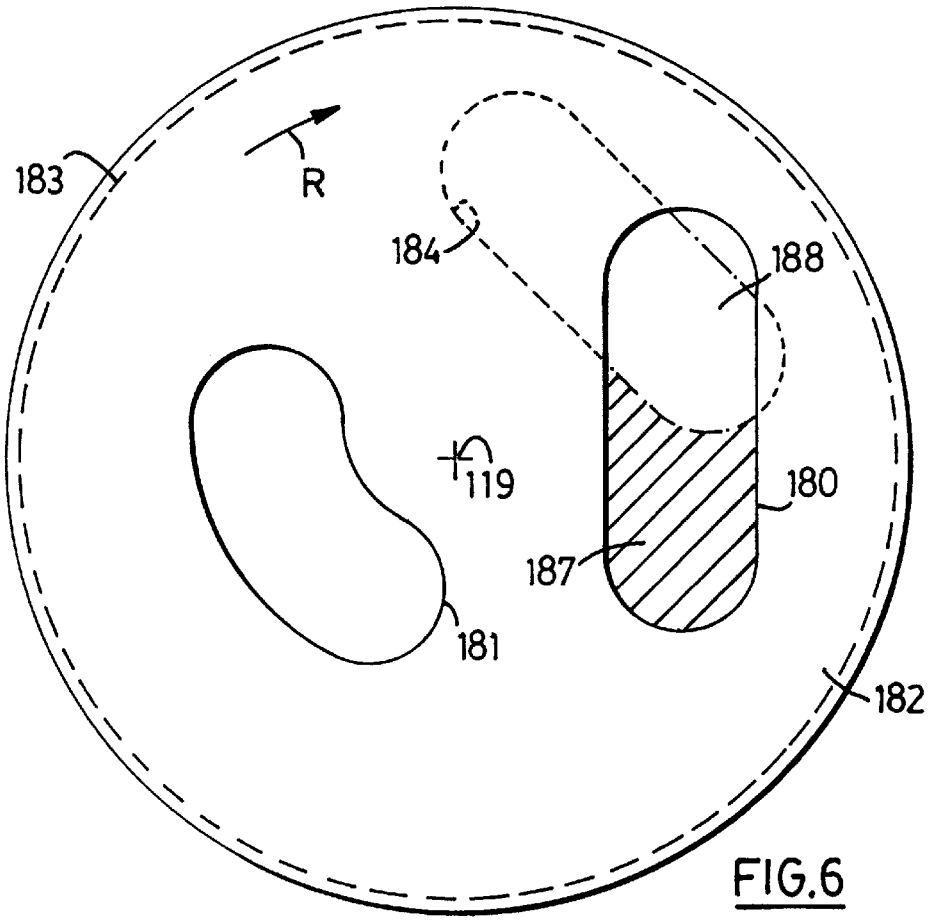
FIG. 6 is a plan view of a gerotor housing with inlet and outlet ports, and a shroud plate.

FIGS. 6 and 7 show inlet port 180 within top body element 182. In this embodiment, exhaust port 181 is located within bottom body element 189. The top and bottom body elements are sometimes referred to herein as first and second end plates. Between top body element 182 and gerotor elements 185 is shroud plate 183, which has shroud port 184 therein. Inner and outer gerotor elements 185 are encased in barrel 186. Inlet port 180 is shown in FIG. 6 and there is an overlap between inlet port 180 and shroud port 184 which leaves an inlet 188 of lesser area than inlet port 180, the remainder being covered by hatched area 187. Hatched area 187 is equivalent to shroud 132 in FIGS. 2 and 3. Arrow R shows the direction of rotation of the inner gerotor element (not shown specifically). Shroud plate 183 can be rotated about axis 119, thus allowing for variation in the area of inlet 188. This of course alters the cut-off for the fluorocarbon vapour or other vapours used as the working fluid in the engine. Shroud plate 183 can be caused to rotate by any suitable means, e.g. rack and pinion gears, screw drives, electromagnetic ratchet drives. Movement of the shroud plate can be at the instance of manual adjustment or automatic adjustment by, for example, a speed regulator.

It will be understood that the size and location of the inlet and exhaust ports will depend in part on the diameter of the gerotor and the number of lobes on the inner gerotor element.

The entry of gaseous working fluid into the gerotor may be cut off by the shroud at various points, up to the point when the expanding cavity in the gerotor is at its maximum. The exhaust port, which is fixed in location and in area, is first exposed to the gaseous working fluid in the cavity at this maximum volume point, and the gaseous working fluid in the cavity is exhausted through the exhaust port to the condenser. Thus the entry flow opening is variable in length, beginning always at the point when the cavity begins to increase in size, but terminating at the forward portion at cut-off points at various controlled positions. The exhaust port opening is fixed and starts just after the end of the period of expansion of the cavity, and terminates when the cavity is at its minimum size.

Figure 8:
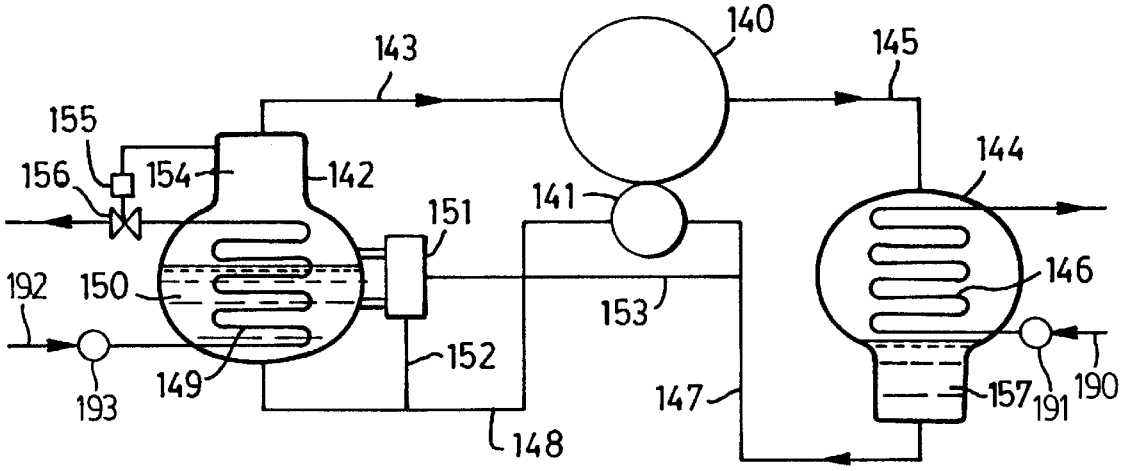
FIG. 8 is a schematic diagram showing an embodiment of the present invention, and showing the path of a working fluid as it passes through a closed cycle, with a representation of controls which may be used.

FIG. 8 shows another method for operating the gerotor in a closed cycle engine. Gerotor 140 is connected to feed pump 141 by a common shaft, geared drive or similar (not shown). Gerotor 140 also has a shaft for utilizing the output power of the driven gerotor. High pressure fluorocarbon gas is supplied to gerotor 140 through inlet port (not shown) from supply vessel 142, via line 143.

The exhaust port (not shown) of gerotor 140 is connected to condenser 144 via line 145. Condenser 144 has cooling coils 146 therein which are cooled with atmospheric air or with water from a cold water supply (not shown). The bottom of condenser 144 is connected to the inlet of feed pump 141 via line 147. The outlet of feed pump 141 is connected to the bottom of evaporator 142 by line 148. Evaporator 142 has heating coils 149 therein which are heated with water from a hot water supply (not shown). It will be understood that other cooling and heating fluids for condenser 144 and evaporator 142 may be used and that air or water is used herein as an illustration. The cooling fluid is introduced into condenser 144 through line 190 by fluid transmitting means 191. The heating fluid is introduced into evaporator 142 through line 192 by fluid transmitting means 193. Fluid transmitting means 191 and 192 may be pumps or fans, depending on the cooling or heating fluids.

In operation, evaporator 142 contains a liquid at its saturation (boiling) temperature and its vapour 154. This can be an inorganic or organic substance. Such liquid and vapour is sometimes referred to herein as the working fluid. Preferably, the working fluid is a fluorocarbon. Fluorocarbon 150 is pumped into evaporator 142 by feed pump 141. The level of liquid fluorocarbon 150 is kept constant by means of float valve 151 which permits excess fluorocarbon fluid to be returned from evaporator 142 to line 147, i.e. the inlet to feed pump 141, via line 153. The pressure of fluorocarbon vapour 154 in evaporator 142 is controlled via pressure controller 155 and hot water supply valve 156. Fluorocarbon vapour 154 then flows into the inlet port (not shown) of gerotor 140 and is exhausted through exhaust port (not shown) to condenser 144. There the fluorocarbon vapour is condensed into liquid 157 by cooling coils 146.

Gerotor 140 not only drives feed pump 141, which takes a small portion of the output gerotor 140, but also may be used to drive other equipment. For example, gerotor 140 may be used to power irrigation equipment, fans, electric generators and other devices. Gerotor 140 has the cut-off device described in relation to FIGS. 2 to 4 and thus is able to run at a substantially constant speed under varying loads and/or to improve the efficiency of utilization of heat from available sources.

The gerotor disclosed herein is particularly useful with low temperature heat sources, particularly those that have temperatures less than about 100° C.

An advantage of the arrangement of the present invention is that the working fluid is sealed within the system, normally requires no make-up and releases no working fluid to the atmosphere.

It will be clear that other modifications can be made to the present invention without departing from the spirit of the invention.

I claim:

1. A process for extracting a first gas from a hot gaseous waste heat source, said first gas having a temperature above ambient temperature, said process comprising:

(i) causing condensed fluorocarbon working fluid to vaporize in an evaporator by extracting the first gas from the hot gaseous waste heat source and passing the first gas in contact with heat transfer surfaces of the evaporator by a first fan, said first fan being driven by an engine;

(ii) allowing the fluorocarbon working fluid so-vaporized to enter the engine through an inlet port and exhaust through an exhaust port and thus operate the engine;

(iii) causing the exhausted fluorocarbon working fluid vapour to condense in a condenser by passing a second fluid, from a cold fluid source, in contact with heat transfer surfaces of the condenser by means of a second fluid transferring means, said second fluid transferring means being driven by the engine;

(iv) cause the condensed fluorocarbon working fluid to be transferred from the condenser to the evaporator by means of a feed pump which is driven by the engine.

2. A process according to claim 1 wherein the second fluid is a gas and the second fluid transferring means is a fan.

3. A process according to claim 2 wherein the first gas is air from within a warm space and the second gas is air from outdoors, wherein the temperature of the first gas is at least 25° C. higher than the temperature of the second gas.

4. A process according to claim 3 wherein the temperature of the first gas is at least 40° C. higher than the temperature of the second gas.

5. A process according to claim 2 wherein the engine is selected from the group consisting of a rotary expander, a reciprocatory expander and an expansion turbine.

6. A process according to claim 2 wherein the first fluid is hot air in a building and the hot air is extracted to atmosphere outside the building, and the second fluid is atmospheric air from outside the building.

7. A process according to claim 6 wherein the second fluid is transferred by the second fan into the building.

8. A process according to claim 1 wherein the second fluid is a liquid and the first and second fluid transferring means are pumps.

9. A process according to claim 1 wherein the engine is selected from the group consisting of a rotary expander, a reciprocatory expander and an expansion turbine.

10. An apparatus comprising:

(a) an engine having an inlet port and an exhaust port for a fluorocarbon working fluid, said engine being operable by a fluorocarbon working fluid;

(b) an evaporator for the fluorocarbon working fluid, said evaporator being connected to the inlet port of said engine to allow evaporated fluorocarbon working fluid gas to enter the inlet port;

(c) a condenser for the fluorocarbon working fluid, said condenser being connected to the exhaust port of said engine, to allow condensation of the fluorocarbon working fluid gas into liquid fluorocarbon working fluid and thus provide a pressure difference for exhaustion of working fluid gas from the exhaust port;

(d) a pump, in driven relationship with the engine, for transferring liquid fluorocarbon working fluid from the condenser to the evaporator;

(e) a first fluid transferring means, in driven relationship with the engine, said first fluid transferring means being positioned to pass a first fluid in contact with heat transfer surfaces of the evaporator;

(f) a second fluid transferring means, in driven relationship with the engine, said second transfer means being positioned to pass a second fluid in contact with heat transfer surfaces of the condenser, and (g) said apparatus containing sufficient fluorocarbon working fluid for operation of the apparatus.

11. An apparatus according to claim 10 wherein the first and second fluids are gases and the first and second fluid transferring means are fans.

12. An apparatus according to claim 10 wherein the engine is selected from a reciprocating engine, a rotary engine and an expansion turbine.

13. An apparatus according to claim 10 wherein the engine is selected from a reciprocating engine, a rotary engine and an expansion turbine.

14. A process for extracting a first liquid from a hot liquid source, said first liquid having a temperature above ambient temperature, said process comprising:

(i) causing condensed working fluid to vaporize in an evaporator by extracting the first liquid from the hot liquid source and passing the first liquid in contact with heat transfer surfaces of the evaporator by means of a first pump, said first pump being driven by an engine;

(ii) allowing the working fluid so-vaporized to enter the engine through an inlet port and exhaust through an exhaust port and thus operate the engine;

(iii) causing the exhausted working fluid vapour to condense in a condenser by passing a second fluid, from a cold fluid source, in contact with heat transfer surfaces of the condenser by means of a fluid transferring means, said fluid transferring means being driven by the engine; wherein when the second fluid is a liquid, the fluid transferring means is a pump, and when the second fluid is a gas, the fluid transferring means is a fan; and (iv) cause the condensed working fluid to be transferred from the condenser to the evaporator by means of a feed pump which is driven by the engine.

15. A process according to claim 14 wherein the second fluid is a liquid and the fluid transferring means is a pump.

16. A process according to claim 14 wherein the second fluid is a gas, and the second fluid transferring means is a fan.

17. An apparatus comprising:

(a) an engine having an inlet port and an exhaust port for a working fluid, said engine being operable by a working fluid;

(b) an evaporator for the working fluid, said evaporator being connected to the inlet port of said engine to allow evaporated working fluid gas to enter the inlet port;

(c) a condenser for the working fluid, said condenser being connected to the exhaust port of said engine, to allow condensation of the working fluid gas into liquid working fluid and thus provide a pressure difference for exhaustion of working fluid gas from the exhaust port;

(d) a pump, in driven relationship with the engine, for transferring liquid working fluid from the condenser to the evaporator;

(e) a first fan, in driven relationship with the engine, said first fan being positioned to extract a hot first gas from within a space and pass a first fluid in contact with heat transfer surfaces of the evaporator;

(f) a second fan, in driven relationship with the engine, said second fan being positioned to pass a second gas in contact with heat transfer surfaces of the condenser; said second fan being in a location selected from the group consisting of i) a location to transfer the second gas into the space from a position outside the space and ii) a location to transfer the second gas from one position outside the space into a second position outside the space.

18. An apparatus according to claim 1 wherein the first and second gases are air and the first fan is positioned to extract hot air from within a space, and the second fan is positioned to transfer cold air into the space from a position outside the space.

19. An apparatus according to claim 17 wherein the first and second gases are air and the first fan is positioned to extract hot air from within a space, and the second fan is positioned to transfer cold air from one position outside the space into a second position outside the space.

* * * * *